US008123056B2

(12) United States Patent
Falzoni

(10) Patent No.: US 8,123,056 B2
(45) Date of Patent: Feb. 28, 2012

(54) CLOSURE ARRANGEMENT WITH OPENING INDICATING (ANTI-TAMPER) ELEMENTS

(75) Inventor: Alessandro Falzoni, Imola (IT)

(73) Assignee: Sacmi Cooperativa Meccanici Imola Societa Cooperativa, Imola (IT)

( * ) Notice: Subject to any disclaimer, the term of this patent is extended or adjusted under 35 U.S.C. 154(b) by 734 days.

(21) Appl. No.: 12/162,396

(22) PCT Filed: Dec. 14, 2006

(86) PCT No.: PCT/IB2006/003607

§ 371 (c)(1),
(2), (4) Date: Oct. 20, 2008

(87) PCT Pub. No.: WO2007/085896

PCT Pub. Date: Aug. 2, 2007

(65) Prior Publication Data

US 2009/0152229 A1 Jun. 18, 2009

(30) Foreign Application Priority Data

Jan. 27, 2006 (IT) ..... MO2006A0029

(51) Int. Cl.
*B65D 1/02* (2006.01)
*B65D 41/32* (2006.01)

(52) U.S. Cl. ..... 215/40; 215/44; 215/252

(58) Field of Classification Search ..... 215/43, 215/44, 46, 252, 253, 40, 42, 258
See application file for complete search history.

(56) References Cited

U.S. PATENT DOCUMENTS

| | | | | |
|---|---|---|---|---|
| 4,448,318 | A * | 5/1984 | Lowe | 215/252 |
| 4,478,343 | A * | 10/1984 | Ostrowsky | 215/252 |
| 4,534,480 | A * | 8/1985 | Santostasi et al. | 215/252 |
| 4,813,561 | A | 3/1989 | Ochs | |
| 4,978,016 | A | 12/1990 | Hayes | |
| 5,007,545 | A * | 4/1991 | Imbery, Jr. | 215/14 |
| 5,058,755 | A * | 10/1991 | Hayes | 215/252 |
| 5,197,619 | A * | 3/1993 | Margaria | 215/256 |
| 5,570,798 | A * | 11/1996 | Hayashida et al. | 215/252 |
| 6,109,464 | A * | 8/2000 | Takano | 215/252 |
| 2002/0134747 | A1 * | 9/2002 | Babcock et al. | 215/252 |
| 2005/0072751 | A1 * | 4/2005 | Price et al. | 215/252 |
| 2005/0189312 | A1 * | 9/2005 | Bixler et al. | 215/252 |
| 2005/0199574 | A1 * | 9/2005 | Bloom et al. | 215/252 |
| 2005/0252878 | A1 * | 11/2005 | Babcock | 215/252 |

FOREIGN PATENT DOCUMENTS

DE 20 2004 015939 12/2004

(Continued)

OTHER PUBLICATIONS

International Search Report for PCT/IB2006/003607, mailed Mar. 20, 2008.

(Continued)

*Primary Examiner* — Sue Weaver
(74) *Attorney, Agent, or Firm* — Nixon & Vanderhye, PC

(57) ABSTRACT

Container, comprising a neck provided with a wall forming an opening and an abutting arrangement arranged to interact with an opening indicating device of a cap associatable with the neck, the abutting arrangement comprising a ring-shaped projection extending circumferentially from the wall, and an abutting element arrangement projecting from the ring-shaped projection.

16 Claims, 14 Drawing Sheets

FOREIGN PATENT DOCUMENTS

| | | | |
|---|---|---|---|
| GB | 2 172 273 | | 9/1986 |
| GB | 2 186 272 | | 8/1987 |
| GB | 2 293 158 | A | 3/1996 |
| JP | 2001-315814 | A | 11/2001 |
| KR | 20040038799 | A | 5/2004 |
| WO | 99/62770 | | 12/1999 |

OTHER PUBLICATIONS

International Preliminary Report on Patentability for PCT/IB2006/003607, mailed Jul. 17, 2008.

* cited by examiner

CLOSURE ARRANGEMENT WITH OPENING INDICATING (ANTI-TAMPER) ELEMENTS

CROSS-REFERENCE TO RELATED APPLICATIONS

This application is the U.S. national phase of International Application No. PCT/IB2006/003607, filed 14 Dec. 2006, which designated the U.S. The entire contents of that application is hereby incorporated by reference.

BACKGROUND

The invention relates to a closure arrangement comprising an abutting arrangement associated with a neck of a container and a cap having an opening indicating device provided with a security ring and a flap arrangement arranged for interacting with the above-mentioned abutting arrangement.

Caps are known consisting of a cylindrical shell comprising a first portion, cooperating with a base wall for defining a base cap body, and a second portion forming an opening indicating device designed to provide a user with information about the integrity of a product packaged in the container.

The above-mentioned second portion comprises a ring which interacts with a projection obtained on the neck of the container.

The projection is ring-shaped and projects from a lateral wall of the neck.

The first portion and the second portions are separated by an intended opening line consisting of a plurality of cuts, or openings, passing through the cylindrical shell and alternating with bridge-like elements extending between the first and second portions, the bridge-like elements being designed to be broken when the container is first opened.

From a zone at the edge of the ring there extends a plurality of flaps which—in use—are positioned inside the cap and directed towards the base wall.

When the container is opened for the first time, the flaps interact with the projection to prevent the ring from being detached from the neck of the container and to promote breakage of the bridge-like elements.

A drawback of known caps is that, during the first opening of a container, it is rather difficult to separate the first portion from the second portion. In particular, the bridge-like elements tend to deform so allowing the ring to rotate together with the base body before breaking.

In that way, the opening indicating device is unreliable, since the container may have been opened and part of the contents removed and also substituted without the bridge-like elements breaking.

This does not allow certainly verify whether or not a container has been tampered with.

SUMMARY

An object of the invention is to improve prior art closure arrangement.

Another object of the invention is to obtain a closure arrangement provided with an opening indicating device which, during first opening of a container can be rapidly and effectively separated from a base body of a cap.

A further object of the invention is to obtain a closure arrangement which prevents an opening indicating device from rotating together with a base body of a cap, when the cap is unscrewed from the neck of a container.

According to a first aspect of the invention, there is provided a container, comprising a neck provided with a wall defining an opening and an abutting arrangement arranged to interact with an opening indicating device of a cap associatable with said neck, said abutting arrangement comprising a ring-shaped projection extending circumferentially from said wall, wherein said abutting arrangement further comprises an abutting element arrangement projecting from said ring-shaped projection.

According to a second aspect of the invention, there is provided a container, comprising a neck provided with a wall defining an opening, an abutting arrangement provided with a ring-shaped projection extending circumferentially from said wall and with an abutting element arrangement projecting from said ring-shaped projection, said container further comprising a cap provided with an opening indicating device, said opening indicating device comprising an active surface arrangement arranged to interact with a face arrangement of said abutting arrangement and a further active surface arrangement arranged to interact with a further face arrangement of said abutting arrangement.

Owing to these aspects of the invention, during the first opening of the container, the abutting element arrangement and the ring-shaped projection promote the separation of the opening indicating device from a base body of the cap. In fact, when the cap is unscrewed from the neck to open the container, a zone of the abutting element arrangement interacts with the active surface arrangement, generating a shearing stress in bridge-like elements interposed between the opening indicating device and the base body, whilst the ring-shaped projection interacts with the further active surface arrangement, generating a normal stress in the bridge-like elements. This allows easier breaking of the bridge-like elements.

In a version, a further zone of the abutting element arrangement also interacts with the further active surface arrangement to contribute to generating the above-mentioned normal stress.

Moreover, the ring-shaped projection forms a grip element which makes the container easier to handle during production steps—for example starting with a container preform—of blowing, moving and filling.

According to a third aspect of the invention, there is provided cap, comprising an opening indicating device provided with a flap arrangement extending along an outer edge of said opening indicating device and arranged to interact with an abutting arrangement associated with a neck of a container, said flap arrangement comprising at least one first flap and at least one second flap, said at least one first flap being provided with a portion and a further portion, a dimension of said further portion, measured transversally to said outer edge, being greater than a further dimension of said portion measured transversally to said outer edge, said second flap being provided with a still further dimension measured transversally to said outer edge which is substantially constant.

Thanks to this aspect of the invention, when the cap is removed from the neck for the first time, the bridge-like elements interposed between the opening indicating device and a base body of the cap is rapidly and effectively broken.

The above-mentioned portion can interact with an abutting arrangement projecting from the neck to generate a tensile stress which promotes breakage of the bridge-like elements.

The above-mentioned further portion can interact with the above-mentioned abutting arrangement to generate a shearing stress which promotes breakage of the bridge-like elements.

The above-mentioned at least one second flap can interact with the above-mentioned abutting arrangement to generate a tensile stress which promotes breakage of the bridge-like elements.

According to a fourth aspect of the invention, there is provided a cap, comprising an opening indicating device provided with an outer edge from which projects a flap arrangement arranged to interact with an abutting arrangement associated with a neck of a container, said flap arrangement comprising a first flap arrangement and a second flap arrangement, said first flap arrangement and said second flap arrangement being distinct from one another, said first flap arrangement having a dimension, measured transversally to said outer edge, which is substantially constant, and said second flap arrangement having a further dimension, measured transversally to said outer edge, which is substantially constant, said dimension being greater than said further dimension. Thanks to this aspect of the invention, it is possible to obtain a cap allowing rapid and effective breakage of bridge-like elements interposed between the opening indicating device and a base body of the cap, when the cap is removed from the neck for the first time.

According to a fifth aspect of the invention, there is provided a cap, comprising an opening indicating device provided with a flap arrangement extending along a part of an outer edge of said opening indicating device and arranged to interact with an abutting arrangement associated with a neck of a container, said flap arrangement comprising at least one first portion, at least one second portion and at least one third portion alongside one another along said outer edge, a dimension of said at least one second portion measured transversally to said outer edge, being greater than a corresponding further dimension of said at least one first portion measured transversally to said outer edge, and than a corresponding still further dimension of said at least one third portion measured transversally to said outer edge.

According to a sixth aspect of the invention, there is provided a cap, comprising an opening indicating device provided with a flap arrangement extending along a part of an outer edge of said opening indicating device and arranged to interact with an abutting arrangement associated with a neck of a container, said flap arrangement comprising at least one first portion and at least one second portion alongside one another along said outer edge, a dimension of said at least one second portion measured transversally to said outer edge, being greater than a corresponding further dimension of said at least one first portion measured transversally to said outer edge, said at least one first portion preceding said at least one second portion in an intended rotation direction along which said cap is screwed on said neck.

According to a seventh aspect of the invention, there is provided a cap, comprising an opening indicating device provided with a flap arrangement extending along an outer edge of said opening indicating device and arranged to interact with an abutting arrangement associated with a neck of a container, said flap arrangement comprising at least one portion and at least one further portion alongside one another along said outer edge, a dimension of said at least one portion measured transversally to said outer edge, being greater than a corresponding further dimension of said at least one further portion measured transversally to said outer edge, said at least one further portion comprising a positioning arrangement arranged to position said at least one further portion in relation to said abutting arrangement.

Thanks to this aspect of the invention, when the container with which the cap is associated is opened for the first time, the positioning arrangement causes the at least one further portion to be positioned below the abutting arrangement so as to guarantee an effective interaction between the flap arrangement and the abutting arrangement, allowing easy separation of the opening indicating device from a base body of the cap.

According to an eighth aspect of the invention, there is provided a cap, comprising an opening indicating device provided with a flap arrangement extending along an outer edge of said opening indicating device and arranged to interact with an abutting arrangement associated with a neck of a container, said flap arrangement comprising at least one first portion and at least one second portion alongside one another along said outer edge, a dimension of said at least one second portion measured transversally to said outer edge, being greater than a corresponding further dimension of said at least one first portion measured transversally to said outer edge, said at least one second portion having a thickness different to a further thickness of said at least one first portion.

According to a ninth aspect of the invention, there is provided a cap, comprising an opening indicating device provided with a flap arrangement extending along an outer edge of said opening indicating device and arranged to interact with an abutting arrangement associated with a neck of a container, said flap arrangement comprising at least one first portion and at least one second portion, a dimension of said at least one second portion measured transversally to said outer edge, being greater than a corresponding further dimension of said at least one first portion measured transversally to said outer edge, said flap arrangement comprising a closing promoting arrangement, arranged to promote sliding of said flap arrangement on said abutting arrangement in an intended rotation direction along which the cap is screwed on the neck.

According to a tenth aspect of the invention, there is provided a cap, comprising an opening indicating device provided with a flap arrangement extending along an outer edge of said opening indicating device and arranged to interact with an abutting arrangement associated with a neck of a container, and a plurality of breakable elements arranged to connect said opening indicating device to a body of said cap, said flap arrangement comprising at least one first portion and at least one second portion alongside one another along said outer edge, a dimension of said at least one second portion measured transversally to said outer edge, being greater than a corresponding further dimension of said at least one first portion measured transversally to said outer edge, said at least one second portion being interposed between two adjacent breakable elements of said plurality of breakable elements.

The flap arrangement comprises active surfaces arranged to interact with zones of the abutting arrangement and further active surfaces arranged to interact with further zones of the abutting arrangement. In particular, the active surfaces interact with the above-mentioned zones in such a way as to prevent the opening indicating device from moving axially relative to the neck when the container is opened for the first time. Moreover, the further active surfaces, positioned substantially along axial planes of the cap, prevent the opening indicating device from being rotated without breaking the bridge-like elements, which connect the opening indicating device to a base body of the cap.

In this way, the bridge-like elements break after the cap has been rotated through a very limited angle relative to the neck.

Therefore, it is possible to obtain a cap which cannot be tampered with without such tampering being clearly shown by the opening indicating device.

Moreover, the flap arrangement, interacting with the abutting arrangement, allows the container to be opened quickly, since the bridge-like elements break immediately thanks to the interaction between the further active surfaces of the flap arrangement and the further zones of the abutting arrangement.

According to an eleventh aspect of the invention, there is provided a container comprising a neck from which extends an abutting arrangement arranged to interact with a flap arrangement with which a cap associatable with said container is provided, said abutting arrangement comprising a plurality of distinct abutting elements, between two consecutive abutting elements of said plurality of abutting elements being defined a space arranged to receive said flap arrangement, said container further comprising a projecting arrangement extending circumferentially from said neck and further from an opening of said container than said abutting arrangement.

During use, the projecting arrangement holds portions of the flap arrangement in a predetermined position in relation to the abutting arrangement. In particular, the projecting arrangement holds the above-mentioned portions in a position substantially parallel with a lateral cylindrical wall of the neck.

Thanks to the projecting arrangement, it is possible, when the container is opened for the first time, to have very large contact zones between the above-mentioned portions and the abutting elements, so that the latter can more effectively exert a contrast action to the flap arrangement when the container is opened for the first time, so promoting early separation of the opening indicating device from a base body of the cap.

BRIEF DESCRIPTION OF DRAWINGS

The invention may be better understood and carried out with reference to the enclosed drawings, which show some exemplifying and non-limitative embodiments thereof, in which.

DETAILED DESCRIPTION

Figure 1:
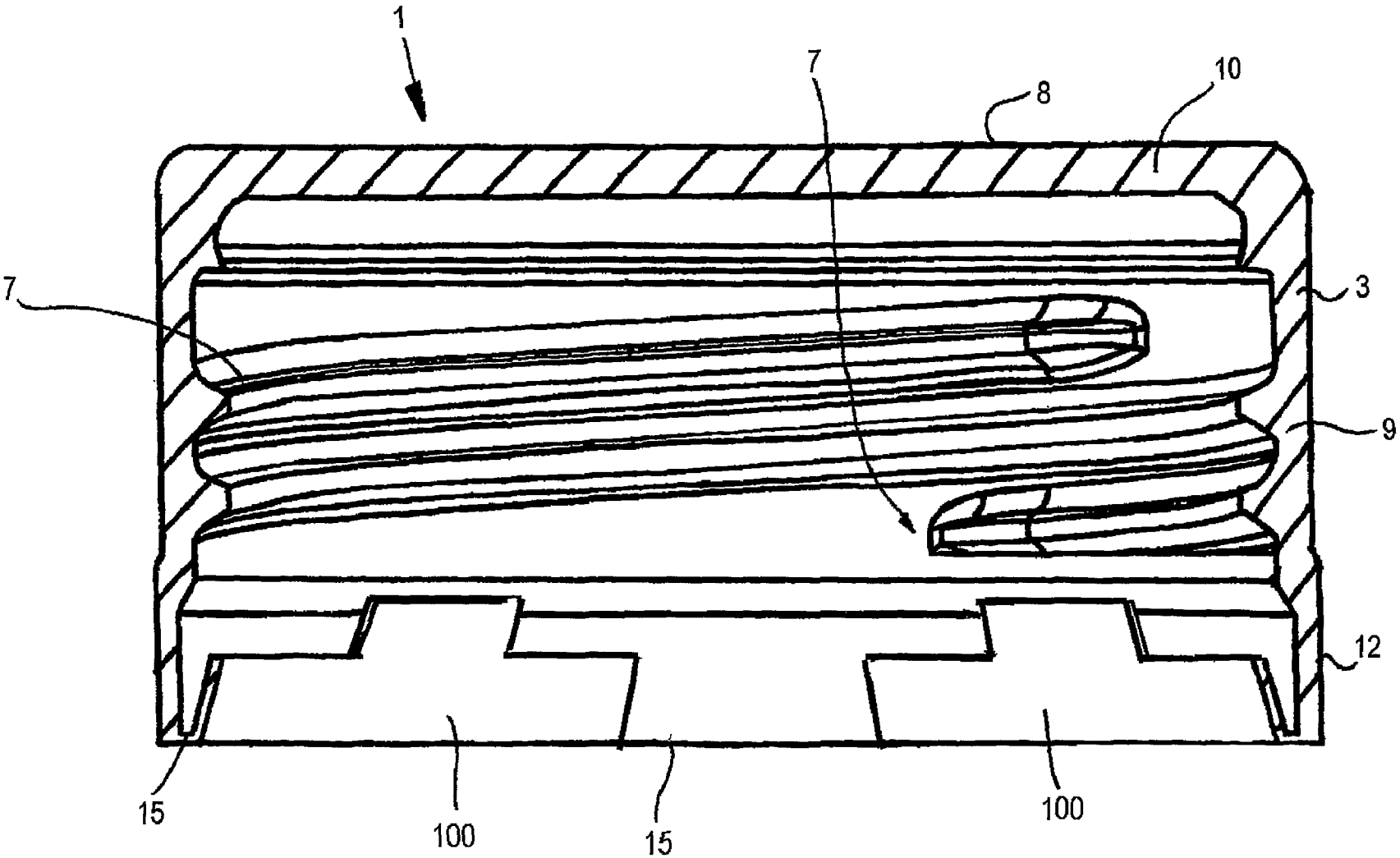
FIG. 1 is an axial section of a cap provided with a flap arrangement.

FIGS. 1 to 8 show a closure arrangement 1 comprising a cap 3 associatable with a container neck 2.

The cap 3 may be made of plastic, moulded by compression or injection.

The neck 2 comprises a mouth 4, having a longitudinal axis A, from which abutting elements 5, arranged to interact with an opening indicating device 6 fitted on the cap 3, project outwards.

The abutting elements 5 are positioned along the outer perimeter of the neck 2 in such a way that a space 17 is defined between two adjacent abutting elements 5. As is better illustrated in FIG. 8, the cap 3 comprises a base body 8 provided with a base wall 10 from which peripherally a lateral wall 9 projects, positioned transversally to the base wall 10.

The lateral wall 9 is internally provided with a threading 7 arranged to engage with a further threading 11 obtained on the mouth 4.

The opening indicating device 6 comprises a security ring 12 (illustrated in FIGS. 1 and from 8 to 12) connected by bridge-like elements 13 to an end portion 14 of the lateral wall 9 opposite to the base wall 10. The bridge-like elements 13 may be obtained, while moulding the cap 3, by forming thicker portions of the opening indicating device 6, or ribs, distributed along the perimeter of the opening indicating device 6. After moulding, a continuous circumferential cut is made in the opening indicating device 6, passing through the lateral wall 9, but not passing through the afore-mentioned thicker portions which in this way define the bridge-like elements 13.

Alternatively, a plurality of through-cuts alternating with uncut portions forming the bridge-like elements 13 may be obtained in the lateral wall 9—having substantially constant thickness—by means of knife having a serrated outline.

A flap arrangement 16 is connected to a lower edge zone 15 of the security ring 12. In use, the flap arrangement 16 is bent inside the cap 3 and, when the container is opened for the first time, the flap arrangement 16 interacts with the abutting elements 5 to promote breakage of the bridge-like elements 13 and so allowing the separation of the security ring 12 from the base body 8.

Figure 2:
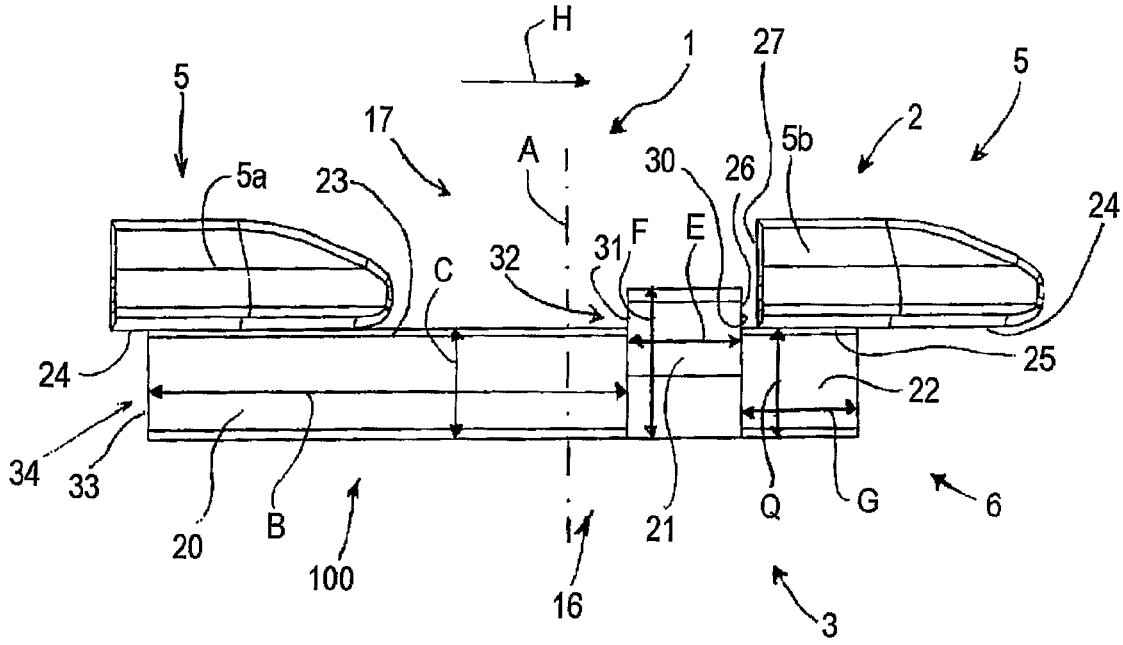
FIG. 2 is an interrupted view of a first version of an opening indicating device, showing a flap arrangement cooperating with an abutting arrangement.

FIG. 2 shows a first version of the opening indicating device 6, in which the flap arrangement 16 comprises a plurality of flaps 100 arranged along the perimeter of the cap 3. In particular, each flap 100 comprises a first flap portion 20, a second flap portion 21 and a third flap portion 22. The first flap portion 20 has a first circumferential extension B, and a first transversal dimension C. The second flap portion 21 has a second circumferential extension E and a second transversal dimension F, greater than the first transversal dimension C.

The third flap portion 22 has a third transversal dimension Q, substantially equal to the first transversal dimension C, and a third circumferential extension G, which may for example be less than the first circumferential extension B.

The second flap portion 21 is interposed between the first flap portion 20 and the third flap portion 22.

When the cap 3 is associated with the neck 2, each second flap portion 21 is positioned in a corresponding space 17 defined by a pair of adjacent abutting elements 5. In said configuration, the first flap portion 20 cooperates with a first abutting element 5*a* of said pair of abutting elements and the third flap portion 22 cooperates with a second abutting element 5*b* of said pair of abutting elements.

In particular, a first active surface 23 of the first flap portion 20 and a second active surface 25 of the third flap portion 22 are arranged to interact with first faces 24 of the abutting elements 5.

The second flap portion 21 comprises a first side 30 which is substantially rectilinear, so that the abutting element 5 can more effectively oppose to a thrust exerted by the second flap portion 21, when the cap 3 is removed from the container for the first time. The first side 30 comprises a third active surface 26 positioned transversally to the second active surface 25 and arranged to interact with a second face 27 of the abutting element 5 extending transversally to the first face 24.

Figure 13:
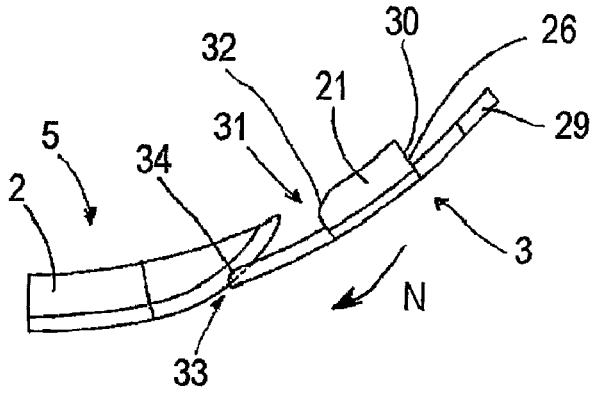
FIG. 13 is an interrupted top view showing a flap arrangement cooperating with an abutting arrangement.

As better illustrated in FIG. 13, the second flap portion 21 comprises a second side 31, opposite the first side 30, which may be rounded, or provided with a bevelled portion 32 lying in a plane transversal to the plane of FIG. 13.

When the cap 3 is screwed on the neck 2 for the first time, to close a container just filled, the bevelled portion 32 promotes sliding of the second flap portion 21 relative to the abutting element 5, in a screwing direction N, so that the second flap portion 21, after passing the abutting element 5, is positioned in the respective space 17.

The second flap portions 21 are so positioned as to be interposed between two adjacent bridge-like elements 13. This allows the second flap portions 21 to bend towards an inner surface 36 of the security ring 12 without interfering with the bridge-like elements 13, so as to facilitate screwing cap 3 when the container is closed for the first time. In other words, the bridge-like elements 13 do not limit the deformability of the second flap portions 21 when the cap 3 is applied to the neck 2.

It is possible to provide that the second flap portions 21 may have a first thickness near to the lower edge zone 15, substantially equal to the thickness of the first flap portions 20 and of the third flap portions 22, and, a second thickness greater than the above-mentioned first thickness near to an end edge 35 opposite to the lower edge zone 15.

Figure 9:
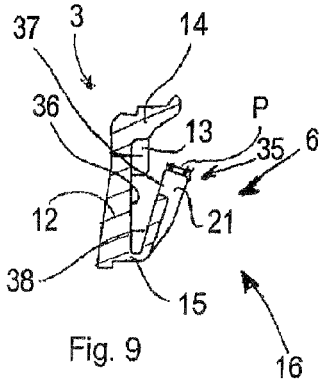
FIG. 9 is an axial section of a portion of a cap provided with a first version of a flap arrangement.

In a first version of the flap arrangement 16, illustrated in FIG. 9, each second flap portion 21 comprises a first surface 37, facing the inner surface 36 when the cap 3 is associated with the neck 2, which is substantially aligned with further first surfaces 38 of the first flap portion 20 and of the third flap portion 23, also facing the inner surface 36. The second flap portion 21 is shaped in such a way that it projects transversally relative to the first flap portion 20 and the third flap portion 23 on the opposite side relative to the further first surfaces 38.

Figure 10:
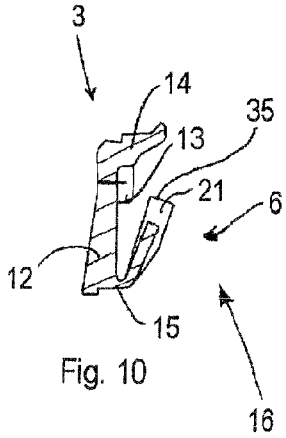
FIG. 10 is an axial section of a portion of a cap provided a second version of a flap arrangement.

In a second version of the flap arrangement 16, illustrated in FIG. 10, each second flap portion 21 is so shaped as to transversally project from both sides relative to the first flap portion 20 and the third flap portion 23.

Figure 11:
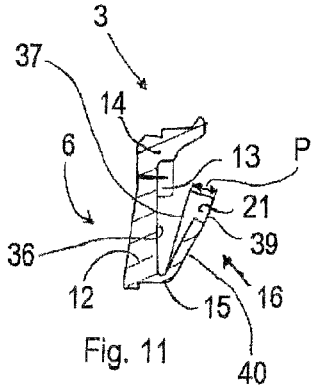
FIG. 11 is an axial section of a portion of a cap provided a third version of a flap arrangement.

In a third version of the flap arrangement 16, illustrated in FIG. 11, each second flap portion 21 comprises a second surface 39, opposite the first surface 37, which is substantially aligned with further second surfaces 40 of the first flap portion 20 and the third flap portion 23. The second flap portion 21 is so shaped as to transversally project relative to the first flap portion 20 and the third flap portion 23 from the opposite side relative to the further second surfaces 40, that is to say, towards the inner surface 36, when the cap 3 is associated with the neck 2.

On the mouth 4 a widened portion 18 is obtained, positioned on the opposite side to the further threading 11 relative to the abutting elements 5 and close to the latter. The widened portion 18 holds the second flap portions 21 in a substantially vertical position, that is to say, substantially parallel with the longitudinal axis A. This allows, when the container is opened for the first time, large contact zones to be obtained between the second flap portions 21 and the abutting elements 5. In this way, the abutting elements 5 can more effectively oppose the flap arrangement 16, and therefore the opening indicating device 6, so promoting the breaking of the bridge-like element 13.

The widened portion 18 may extend along an entire circumferential perimeter of the neck 2, or it may be interrupted, for example so that the widened portion 18 only occupies zones between adjacent abutting elements 5, that is to say, zones positioned at the spaces 17.

When the container is opened for the first time, the cap 3 is unscrewed from the neck 2 and is rotated in a rotation direction H (illustrated in FIG. 2). During the rotation, the third active surfaces 26 come to rest on the second faces 27, thus preventing the opening indicating device 6 from rotating together with the base body 8. In this way, there is a relative rotation between the base body 8 and the opening indicating device 6 which generates a shearing stress on the bridge-like elements 13. Moreover, as the cap 3 is unscrewed, the base body 8 is distanced from the abutting elements 5, moving parallel to the longitudinal axis A. The first faces 24 interacting with the first active surfaces 23 and the second active surfaces 25, axially stop the flap arrangement 16 and, therefore, the opening indicating device 6. This generates a tensile stress which together with the above-mentioned shearing stress rapidly and effectively breaks the bridge-like elements 13.

Figure 3:
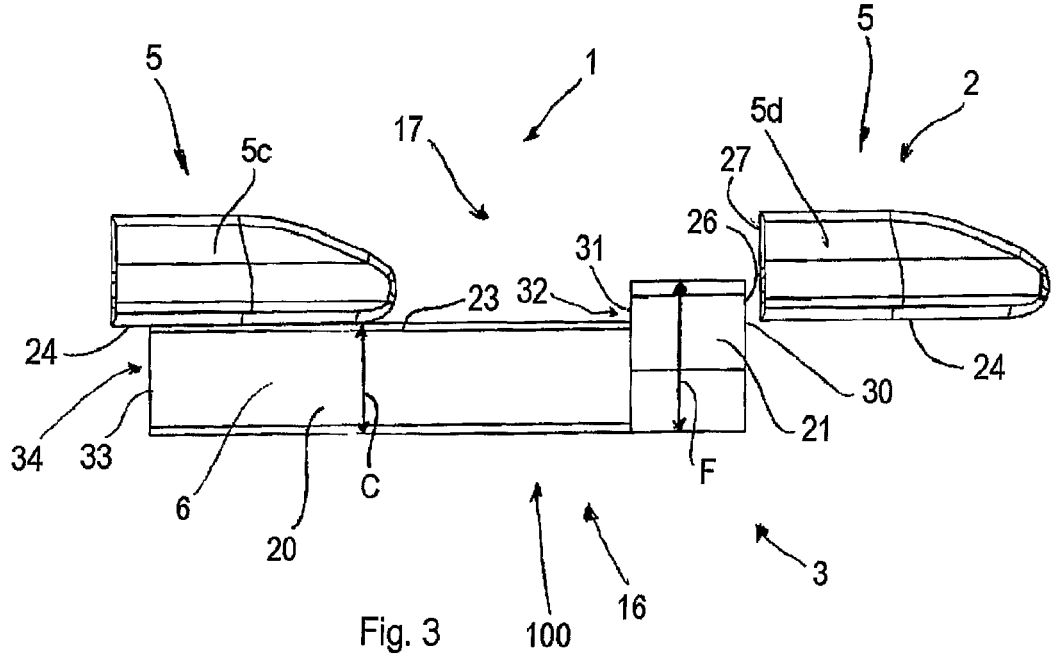
FIG. 3 is an interrupted view of a second version of an opening indicating device, showing a flap arrangement cooperating with an abutting arrangement.

FIG. 3 illustrates a second version of the opening indicating device 6, in which the flaps 100 are shaped in a substantially similar way to that described with reference to FIG. 2, but they are devoid of the third flap portions 22. In this way, the opening indicating device 6 is only axially stopped by the first flap portions 20 which act, by means of the first active surfaces 23, on the first faces 24. The bridge-like elements 13 are broken in a similar way to that described with reference to the first version of the opening indicating device shown in FIG. 2.

In particular, when the cap 3 is removed from the neck 2 for the first time, the first flap portion 20 cooperates with an abutting element 5*c* of a pair of abutting elements and the third flap portion 22 cooperates with a further abutting element 5*d* of said pair of abutting elements.

Similarly to what was described for the first version of the opening indicating device 6, the opening indicating device 6 according to the second version may be provided with second flap portions 21 shaped as described with reference to FIG. 9, or FIG. 10, or FIG. 11.

Figure 4:
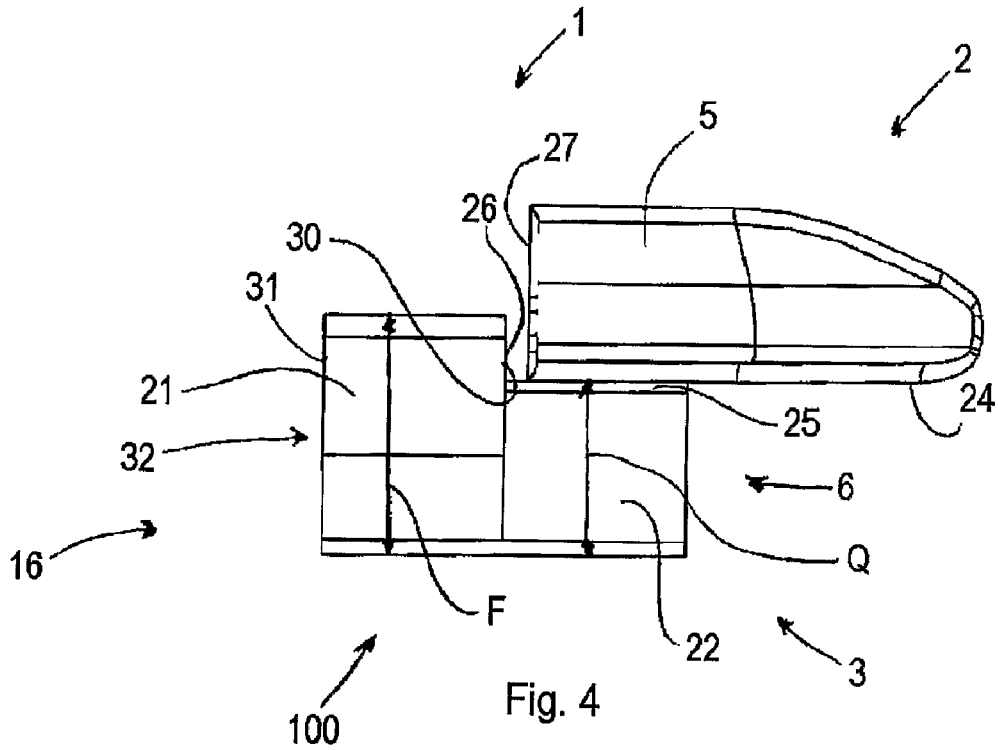
FIG. 4 is an interrupted view of a third version of an opening indicating device, showing a flap arrangement cooperating with an abutting arrangement.

FIG. 4 illustrates a third version of opening indicating device 6, in which the flaps 100 comprise second flap portions 21 and third flap portions 22, but are devoid of first flap portions 20. When the container is opened for the first time, the opening indicating device 6 is axially stopped only by the third flap portions 22 which act, by means of the second active surfaces 25, on the first faces 24. The second flap portions 21, cooperating with the abutting elements 5, prevent the opening indicating device 6 from rotating together with the base body 8, similarly to what was described with reference to FIG. 2.

Similarly to what was described for the first version of the opening indicating device 6, also the opening indicating device 6 according to the third version may be provided with second flap portions 21 shaped as described with reference to FIG. 9, or FIG. 10, or FIG. 11.

Figure 5:
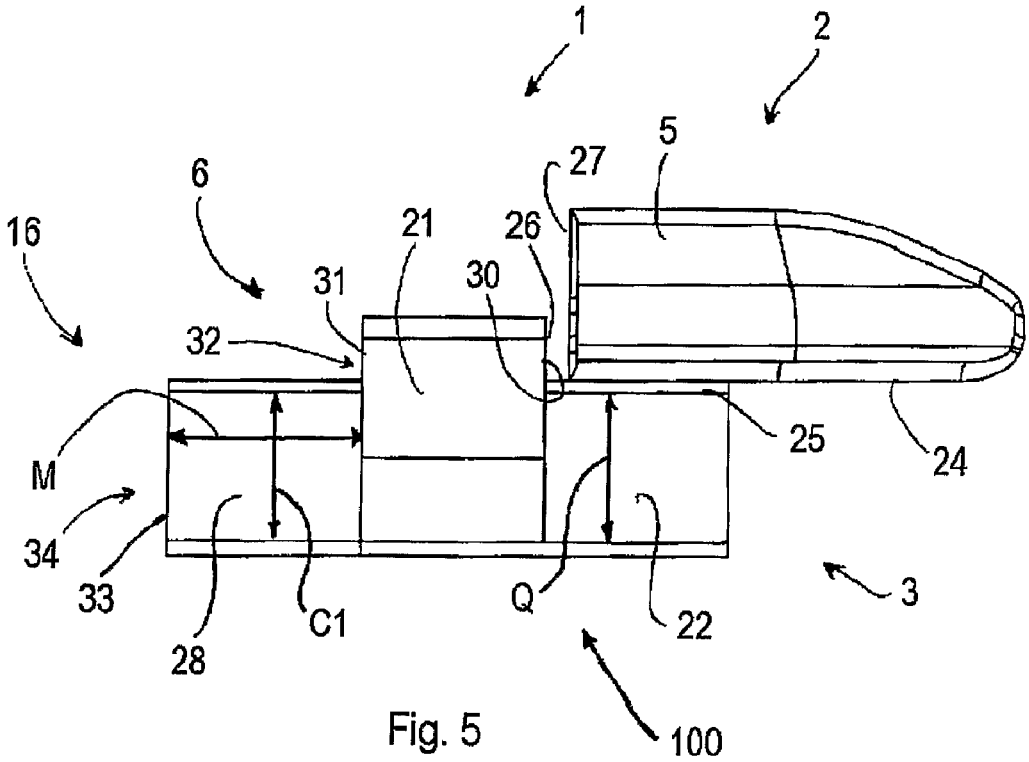
FIG. 5 is an interrupted view of a fourth version of an opening indicating device, showing a flap arrangement cooperating with an abutting arrangement.

FIG. 5 illustrates a fourth version of the opening indicating device 6, in which the flaps 100 are shaped in a similar way to that described with reference to FIG. 2.

Instead of the first flap portion 20 there is a further first flap portion 28 having a further first transversal dimension C1 substantially equal to the third transversal extension Q of the third flap portion 22 and a further first circumferential extension M less than the first circumferential extension B, so that the further first flap portion 28 is received in a corresponding space 17, together with the second flap portion 21.

When the cap 3 is opened, the third flap portion interacts with an abutting element 5, whilst the further first flap portion 28 does not interact with any abutting element 5.

Similarly to what was described for the first version of the opening indicating device 6, the opening indicating device 6 according to the fourth version may also be provided with second flap portions 21 shaped as described with reference to FIG. 9, or FIG. 10, or FIG. 11.

Figure 6:
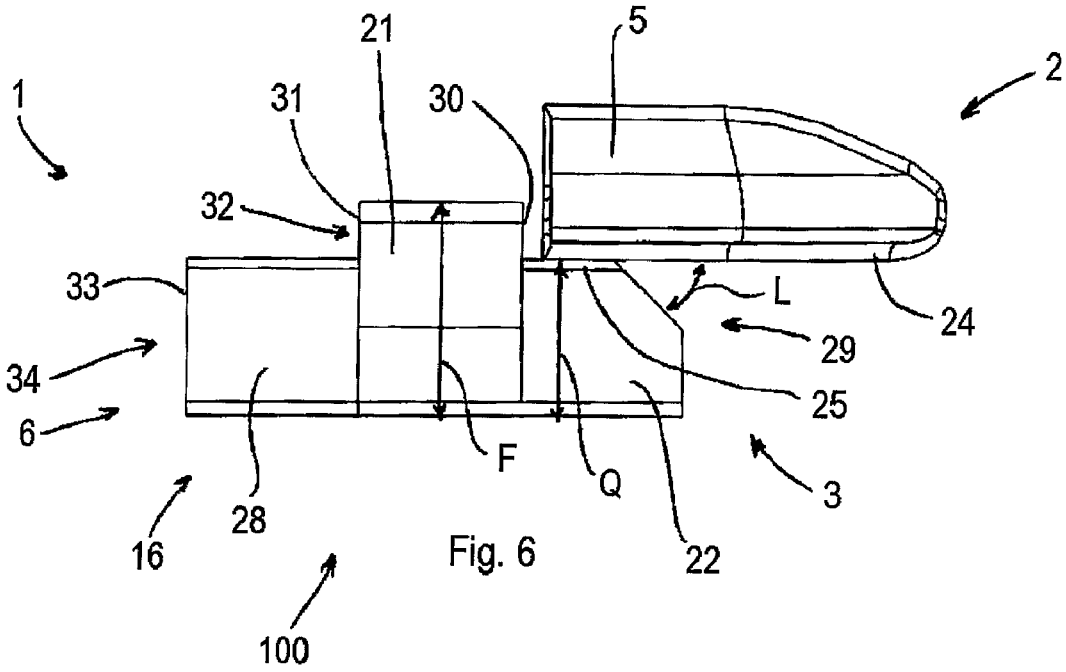
FIG. 6 is an interrupted view of a fifth version of an opening indicating arrangement, showing a flap arrangement cooperating with an abutting arrangement.

FIG. 6 shows a fifth version of the opening indicating device 6, similar to the fourth version of the opening indicating device 6 of FIG. 5, in which each flap 100 comprises a third flap portion 22 in which is obtained a bevel 29 affecting part of the second active surface 25 and lying on a plane substantially perpendicular to the plane of FIG. 6. Between the bevel 29 and the first face 24 an acute angle L is defined.

When the cap 3 is rotated in such a way as to disengage it from the neck 2, the bevel 29 causes the third flap portion 22 to position below the corresponding abutting element 5, so that the second active surface 25 contacts the first face 24.

The bevel 29 may also be provided in the flap arrangement 16 in FIGS. 2, 4 and 5.

Similarly to what was described for the first version of the opening indicating device 6, also the opening indicating device according to the fifth version 6 may be provided with second flap portions 21 shaped as described with reference to FIG. 9, or FIG. 10, or FIG. 11.

The first flap portion 20, in the versions illustrated in FIGS. 2 and 3, and the further first flap portion 28 in FIGS. 5 and 6, comprise a third side 33, opposite the first side 30, which may be rounded in a zone facing the neck 2, or may have a further bevel 34, as illustrated in FIG. 13.

When the cap 3 is screwed on the neck 2 to close a container for the first time, the third bevel 34 promotes sliding of the first flap portion 20, or of the further first flap portion 28, in the screwing direction N, on an outer surface of a corresponding abutting element 5. This facilitates positioning the first flap portion 20 or the further first flap portion 28, below the abutting elements 5.

Figure 12:
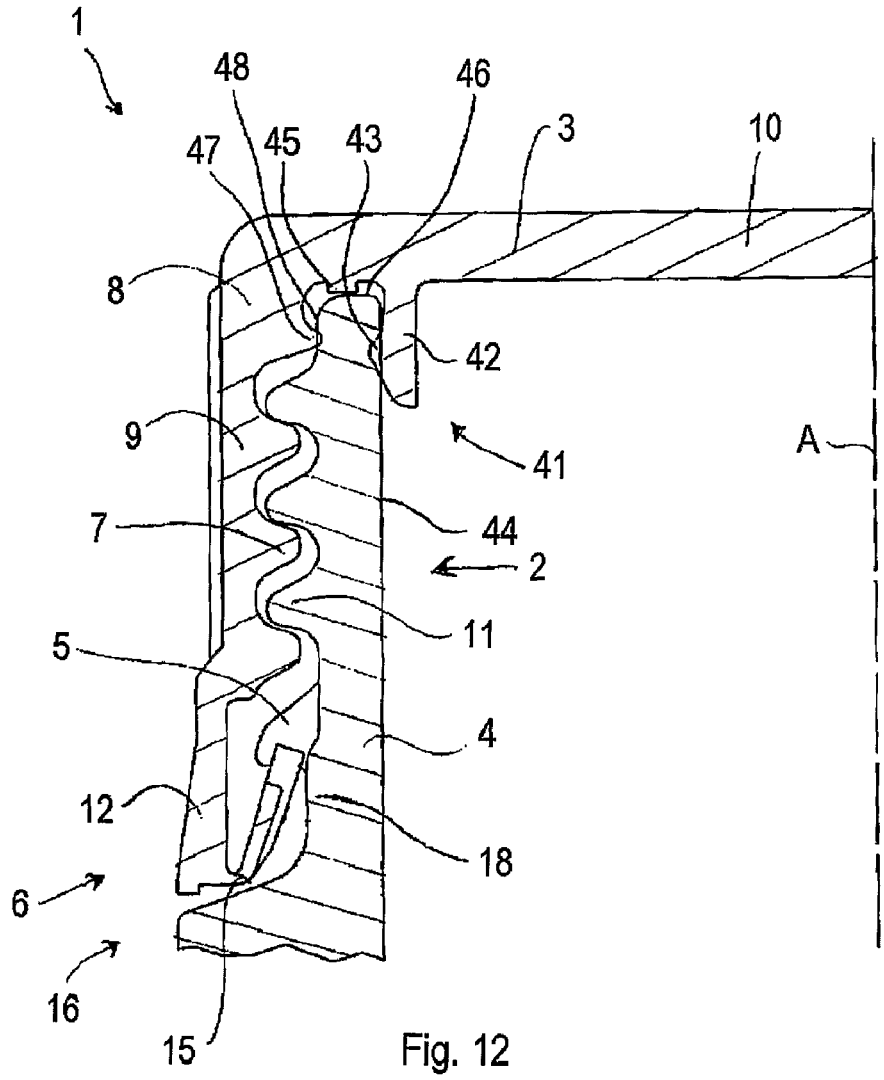
FIG. 12 is an interrupted axial section showing a version of a cap associated with a container neck.

FIG. 12 illustrates a version of the cap 3 provided with a seal portion 41 which allows the inside of the container to be effectively isolated from the outside environment.

The seal portion 41 comprises a ring-shaped wall 42 projecting transversally from the base wall 10 and substantially coaxially with the longitudinal axis A, so as to be positioned in use inside the mouth 4. On the ring-shaped wall 42 a first projecting portion 43 is obtained which radially projects away from the longitudinal axis A and that is arranged to cooperate with a cylindrical inner surface 44 of the mouth 4.

The seal portion 41 comprises a second projecting portion 45 projecting in the same direction as the ring-shaped wall 42 and interposed between the latter and the lateral wall 9.

The second projecting portion 45 is shaped in such a way to cooperate with a mouth surface 46 of the neck 2 that, in use, faces the base wall 10.

Furthermore, the seal portion 41 further comprises a third projecting portion 47 arranged close to the second projecting portion 45 and projecting from the lateral wall 9 towards the ring-shaped wall 42. The third projecting portion 47 is so shaped as to cooperate, in use, with a cylindrical outer surface 48 of the neck 2. The seal portion 41 may be present on any of the versions of the cap 3 described with reference to FIGS. 1 to 11.

Figure 14:
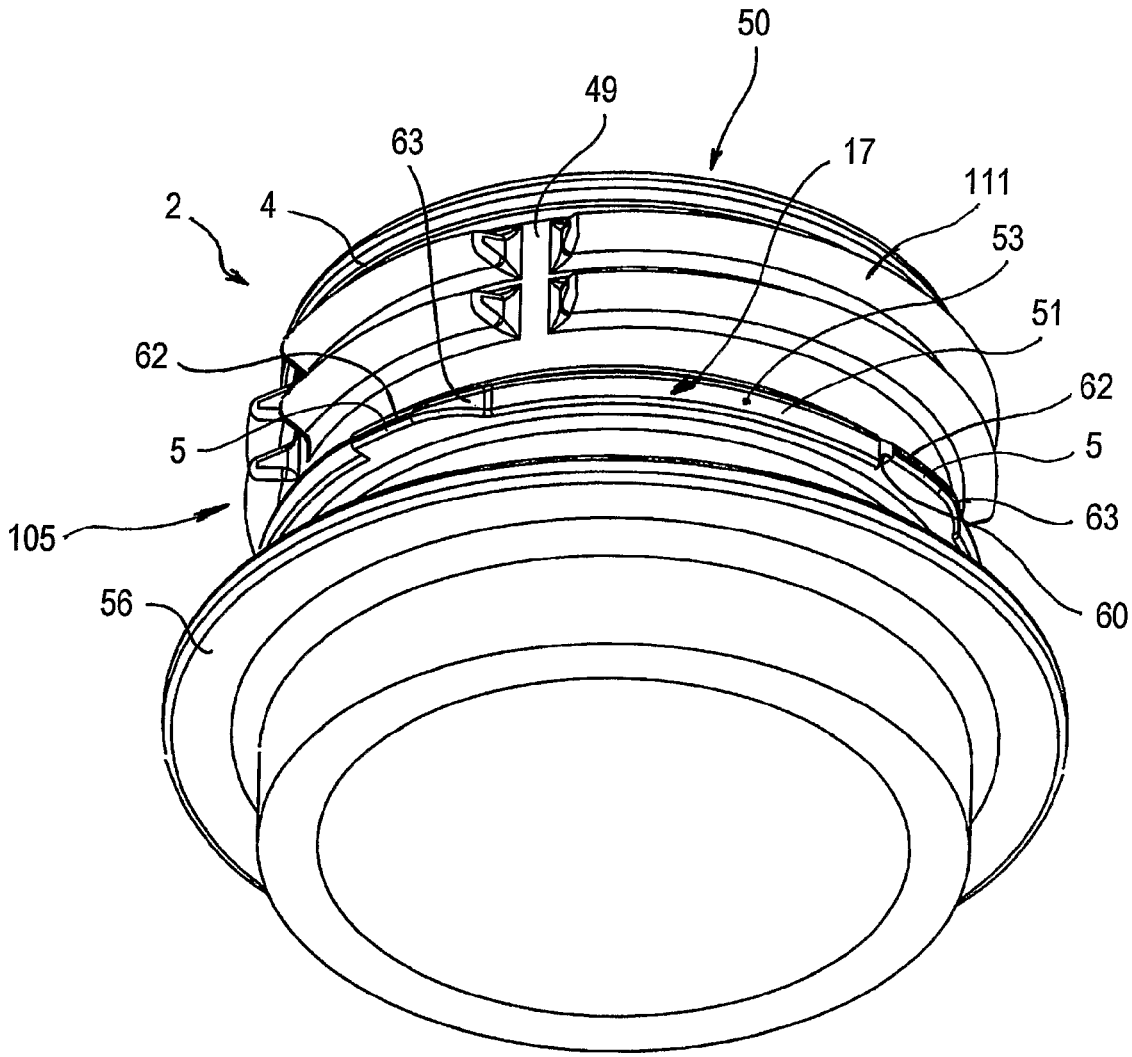
FIG. 14 is a perspective view from below of a container neck provided with an abutting arrangement.

FIG. 14 illustrates a neck 2 of a container, for example a bottle or a container preform, comprising a wall 49 defining an opening 50 through which a product can be inserted into, or removed from, the container.

The neck 2 comprises a threading 111, arranged externally to a mouth portion 4 of the container.

The neck 2 may comprise a collar 56 positioned below the threading 111 and projecting from the wall 49.

The threading 111 is arranged to engage with a corresponding further threading internally provided on a cap, which may be associated with the neck 2 to close the opening 50.

The neck 2 further comprises an abutting arrangement 105 arranged to interact with an opening indicating device with which the cap is provided.

The abutting arrangement 105 comprises a ring-shaped projection 51 extending circumferentially from the wall 49 and from which abutting elements 5 project outwards.

The abutting elements 5 are distinct from one another and are so arranged along the outer perimeter of the ring-shaped projection 51 that a space 17 is defined between two adjacent abutting elements 5.

Figure 15:
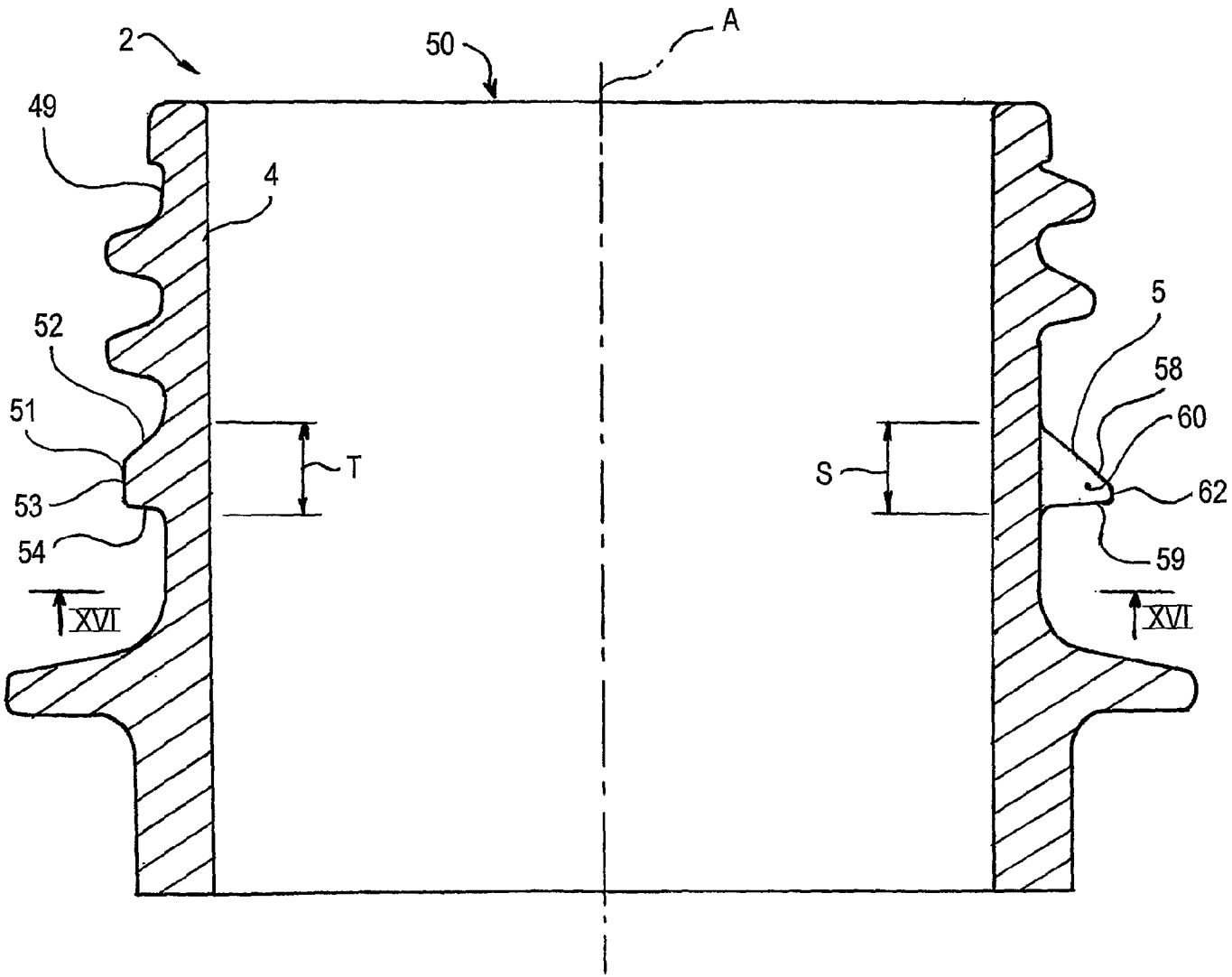
FIG. 15 is an axial section of the neck of FIG. 14.

As illustrated in FIG. 15, the ring-shaped projection 51 comprises a first wall 52 defined by a portion of surface having a cone-shaped outline, or having a profile suitable for allowing the opening indicating device to easily pass beyond the ring-shaped projection 51 when the cap is associated with the neck 2 for the first time.

The ring-shaped projection 51 further comprises a second wall 53 defined by a portion of surface which is substantially cylindrical and substantially parallel to the wall 49.

The ring-shaped projection 51 further comprises a first face 54, substantially flat and positioned almost parallel to a plane defined by the opening 50.

The first face 54 has the shape of a circular crown.

The second wall 53 delimits a zone of the spaces 17 closer to the longitudinal axis A.

Each abutting element 5 comprises a further first wall 58, delimiting at the upper part each abutting element 5, and a further first face 59, delimiting at the lower part each abutting element 5.

The further first wall 58 may lie on an extension of the first wall 52.

Similarly, the further first face 59 may lie on an extension of the first face 54. In such a case, the further first face 59 and the first face 54 are substantially coplanar. Moreover, the abutting elements 5 have a maximum thickness S, measured parallel to a longitudinal axis A of the neck 2, substantially equal to the maximum thickness T of the ring-shaped projection 51, also measured parallel to the longitudinal axis A of the neck 2. In other words, the abutting elements 5 do not project axially from the ring-shaped projection 51, but each abutting element 5 extends substantially radially from the ring-shaped projection 51.

Figure 16:
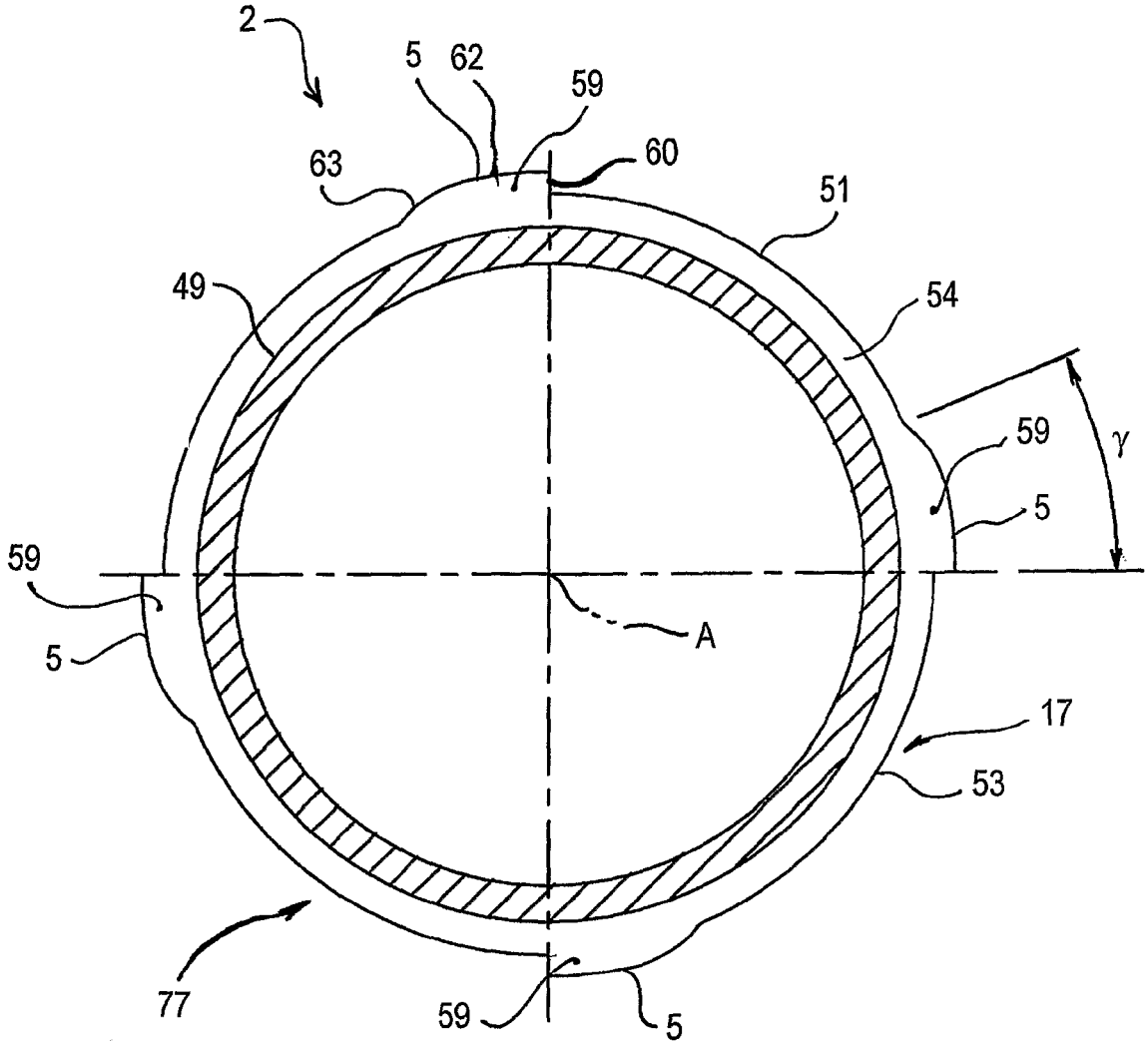
FIG. 16 is a section along the plane XVI-XVI shown in FIG. 15.

With reference to FIG. 16, each further first face 59 projects radially from the first face 54 and extends circumferentially through an acute angle γ. The abutting elements 5, and, therefore, also the further first faces 59, are positioned at a substantially constant angular pitch.

The first face 54 and the further first faces 59 together define a face arrangement 77 arranged to interact with the flap arrangement of the opening indicating device in the manners described below.

Between the further first wall 58 and the further first face 59 is interposed a fourth wall 62 defined by a portion of surface which is cylindrical and substantially parallel to the wall 49.

Each abutting element 5 further comprises a second face 60, substantially flat, tilted in relation to the plane defined by the opening 50 and arranged to interact with a flap arrangement of the opening indicating device in the manners described below.

In particular, the second face 60 is substantially perpendicular to the above-said plane, that is to say, it is positioned radially relative to the neck 2.

Each abutting element 5 further comprises a connecting wall 63 interposed between the fourth wall 62 and the second wall 53. The connecting wall 63 may be defined by a curved surface.

Each abutting element 5 has a dimension measured radially relative to the neck 2 which increases from the connecting wall 63 towards the second face 60, until it reaches its maximum value at the fourth wall 62.

Figure 17:
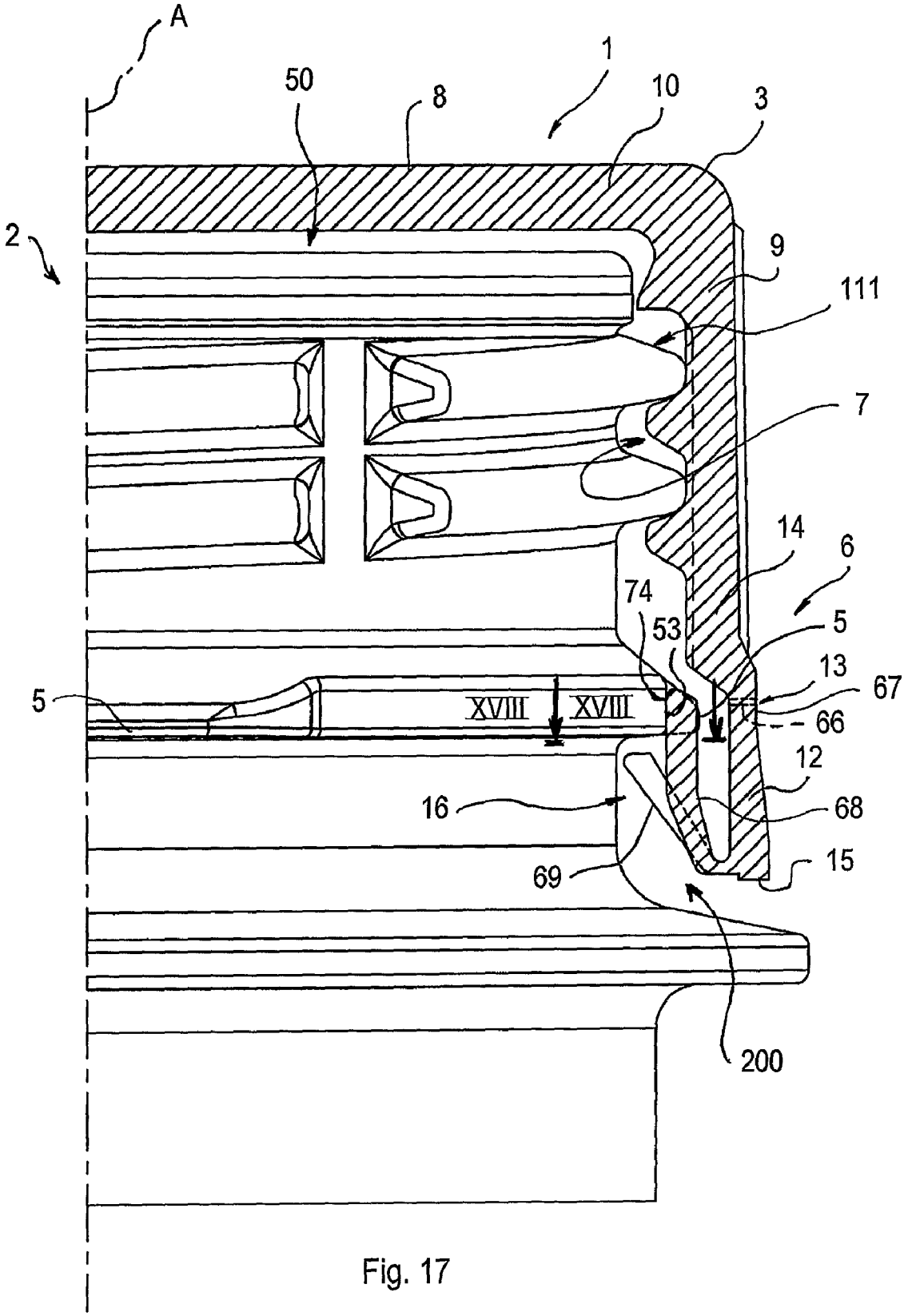
FIG. 17 is a front view, partly enlarged and partly sectioned, showing the neck of FIG. 14 to which a cap according to a version is associated.

FIG. 17 illustrates a closure arrangement 1 comprising the neck 2, according to the version of FIG. 14, and a cap 3 associated to the neck 2 to close the opening 50.

The cap 3 comprises a base body 8 provided with a base wall 10 from which a lateral wall 9 peripherally projects, that is positioned transversally to the base wall 10. The lateral wall 9 is internally provided with a further threading 7 arranged to engage with the threading 111 of the neck 2.

The cap 3 comprises opening indicating device 6.

The opening indicating device 6 comprises a security ring 12 connected by bridge-like elements 13 to an end portion 14 of the lateral wall 9 opposite to the base wall 10. Between bridge-like elements 13 positioned consecutively along an upper edge 67 of the security ring 12 there is provided weakened zones, made, for example, by cuts 66. The cuts 66, which may be through-cuts, form a zone for intended separation between the security ring 12 and the base body 8.

A flap arrangement 16 is connected to a lower edge zone 15 of the security ring 12. In use, the flap arrangement 16 is bent inside the cap 3 and, when the container is opened for the first time, the flap arrangement 16 interacts with the abutting arrangement 105 to promote breakage of the bridge-like elements 13 and, therefore, allowing the separation of the security ring 12 from the base body 8.

In the version of the cap 3 illustrated in FIGS. 17 to 20, the flap arrangement 16 has a plurality of flaps 200 comprising first flaps 68 and second flaps 69 arranged along the perimeter of the cap 3.

The first flaps 68 may alternate with the second flaps 69 along the lower edge zone 15, so that between two consecutive first flaps 68 it is interposed a second flap 69 and, similarly, so that between two consecutive second flaps 69 it is interposed a first flap 68.

Each first flap 68 comprises a first flap portion 121, having a first circumferential extension E' and a first transversal dimension F', and a second flap portion 122, having a second circumferential extension G' and a second transversal dimension Q'. The first circumferential extension E' may be substantially equal to the second circumferential extension G'.

The first transversal dimension F' is greater than the second transversal dimension Q'.

Each second flap 69 has a circumferential extension U and a transversal dimension V.

The circumferential extension U may be greater than the sum of the first circumferential extension E' and the second circumferential extension G'.

The transversal dimension V is substantially equal to the second transversal dimension Q'.

Figure 18:
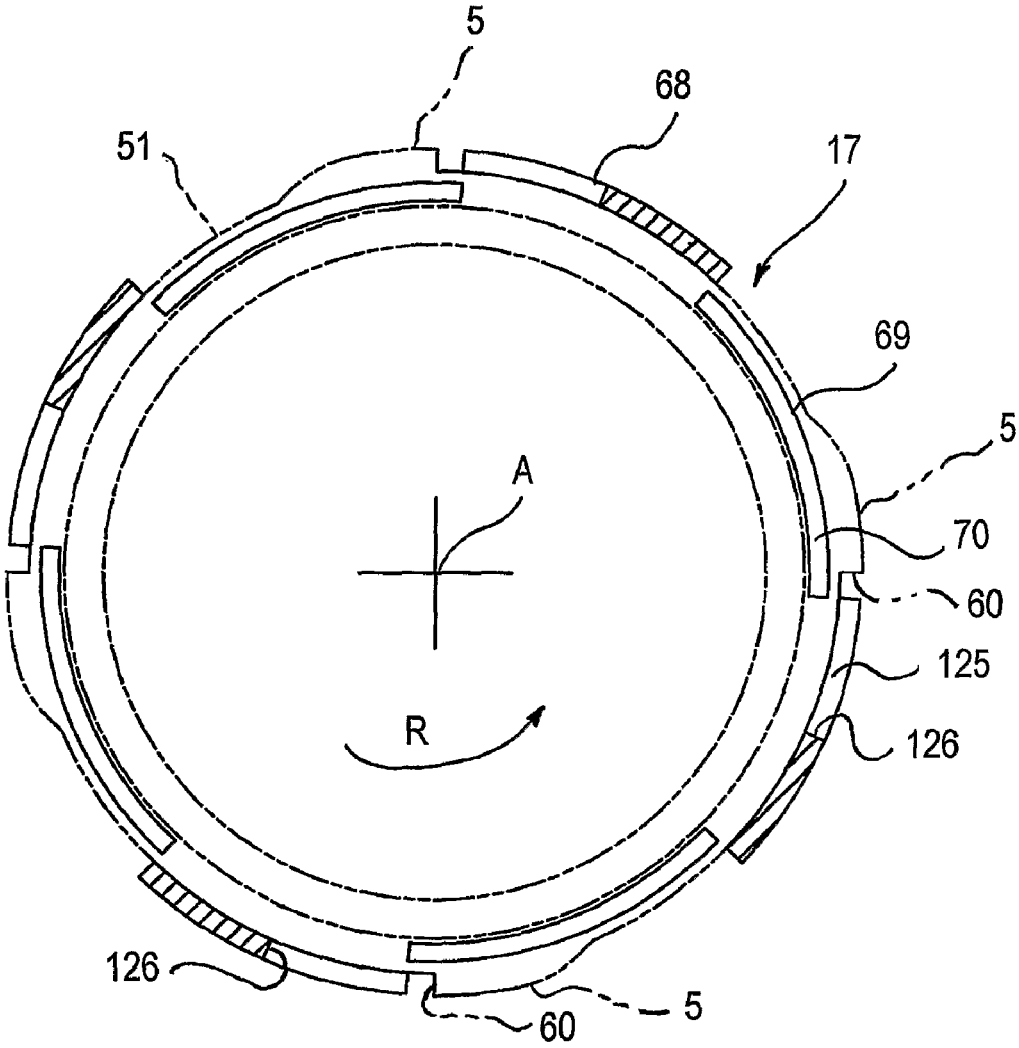
FIG. 18 is a section along the plane XVIII-XVIII shown in FIG. 17 showing a position of a flap arrangement, provided in the cap, relative to the abutting arrangement when the cap is associated to the neck.
Figure 19:
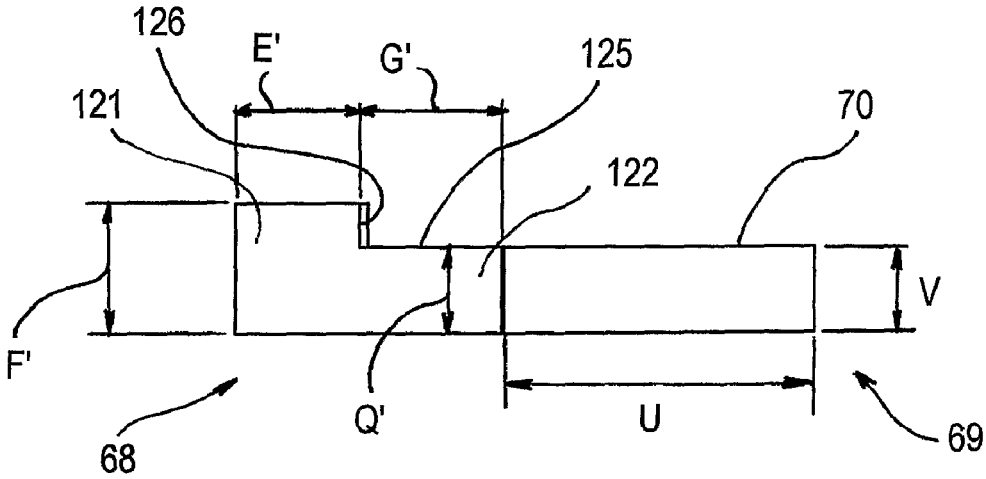
FIG. 19 is a partial side view of the flap arrangement of FIG. 18.

FIG. 18 illustrates the position of the first flaps 68 and of the second flaps 69 relative to the ring-shaped projection 51 (illustrated with a line with double dashes because it is not intercepted by the plane of section XVIII-XVIII of FIG. 17). When the cap 3 is associated with the neck 2 of FIG. 14, each first flap 68 is positioned in a space 17 between a pair of adjacent abutting elements 5, and each second flap 69 is below the ring-shaped projection 51.

The first flap portion 121 is provided with a first active surface 126, arranged to interact with the second face 60 of the abutting element 5, and the second flap portion 122 comprises a second active surface 125, positioned transversally relative to the first active surface 126 to interact with the further first face 59 of the abutting element 5.

The second flaps 69 are provided with a third active surface 70, substantially parallel to the second active surface 125 and arranged to interact with the first face 54 of the ring-shaped projection 51.

Starting from the position illustrated in FIG. 18, when the cap 3 is rotated, along a direction indicated by the arrow R, to open the opening 50, the security ring 12 and also the plurality of flaps 200, rotate together with the base body 8 of the cap 3, until the first flap portions 121 contact respective abutting elements 5.

In this position, the first active surface 126 cooperates with the second face 60 of the abutting element 5 to prevent any further rotation of the security ring 12. Since the security ring 12 is blocked whilst the base body 8 of the cap 3 continues to rotate, a shearing stress is generated acting on the bridge-like elements 13.

When the cap 3 is unscrewed from the neck 2, through rotation of the base body 8 on the threading 111, the base body 8 is distanced from the security ring 12 in a direction parallel to the longitudinal axis A. The second active surfaces 125 and the third active surfaces 70 make contact respectively with the further first face 59 and with the first face 54 so as to axially block the security ring 12 relative to the base body 8. This generates a tensile stress which acts on the bridge-like elements 13.

The combination of the above-mentioned shearing and tensile stresses promotes a rapid, effective breakage of the bridge-like elements 13.

In the version of the neck 2 illustrated in FIGS. 14 to 17 and 21, the ring-shaped projection 51 provides a large surface against which the flap arrangement 16 can be blocked in order to promote the traction of the bridge-like element 13. This allows the tensile stress to be distributed along the entire perimeter of the security ring 12 and not just at the abutting elements 5.

Thanks to the ring-shaped projection 51, it is possible to promote the breakage of the bridge-like elements 13 without the security ring 12 asymmetrically deforming relative to the longitudinal axis A, for example forming a corner close to each abutting element 5.

Moreover, the ring-shaped projection 51 allows the tensile stress acting on the bridge-like elements 13 to be distributed in such a way that stress is substantially uniformly applied to the latter and the bridge-like elements 12 can break practically simultaneously.

Moreover, the ring-shaped projection 51 defines a zone of the container—having significant size—with which a guiding and transporting device can interact to move the container, for example, along a container production and/or filling line. Again with reference to FIG. 17, the first flaps 68 are provided with a resting surface 74 cooperating with the second wall 53 of the ring-shaped projection 51 to hold the first flap portion 121 in a substantially vertical position, that is to say, substantially parallel with the longitudinal axis A. The seconds flaps 69 are tilted in relation to the first flaps 68 towards the longitudinal axis A.

Figure 20:
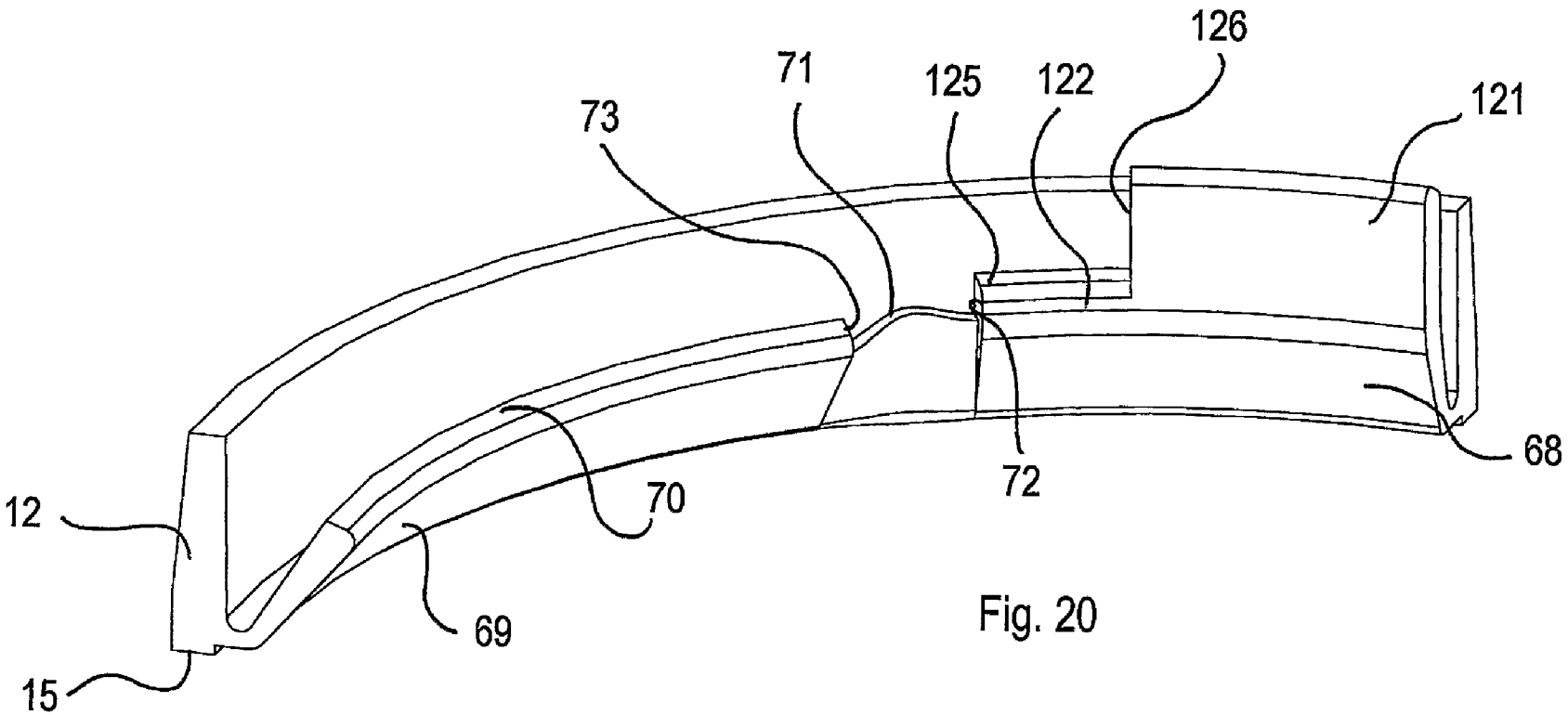
FIG. 20 is a perspective view of the flap arrangement of FIG. 19.
Figure 21:
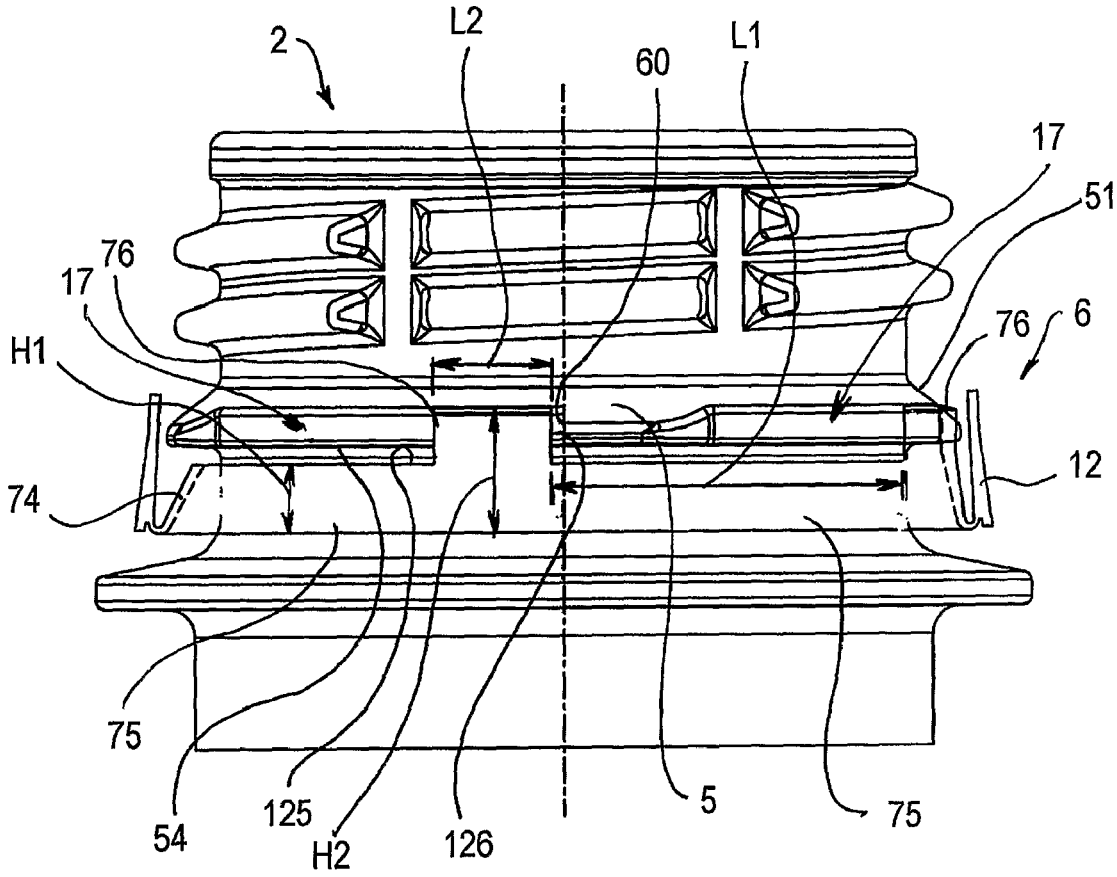
FIG. 21 is a schematic front view of the neck of FIG. 14 with which a cap according to a further version is associated.

With reference to FIG. 20, a portion of the security ring 12 provided with the first flap 68 and with the second flap 69 it is shown.

Between the second flap portion 122 and the second flap 69 it is interposed a joining element 71. The joining element is thinner than the first flap 68 and than the second flap 69 and forms a flexible connecting portion. The joining element 71 joins one side 72 of the second flap portion 122 furthest from the first flap portion 121 to a further side 73 of the second flap 69.

The joining element 71 prevents the second flap 69 from tipping over, in particular when the container is opened, since in use the second flap 69 is tilted in relation to the longitudinal axis A of an angle greater than the first flap 68.

Figure 7:
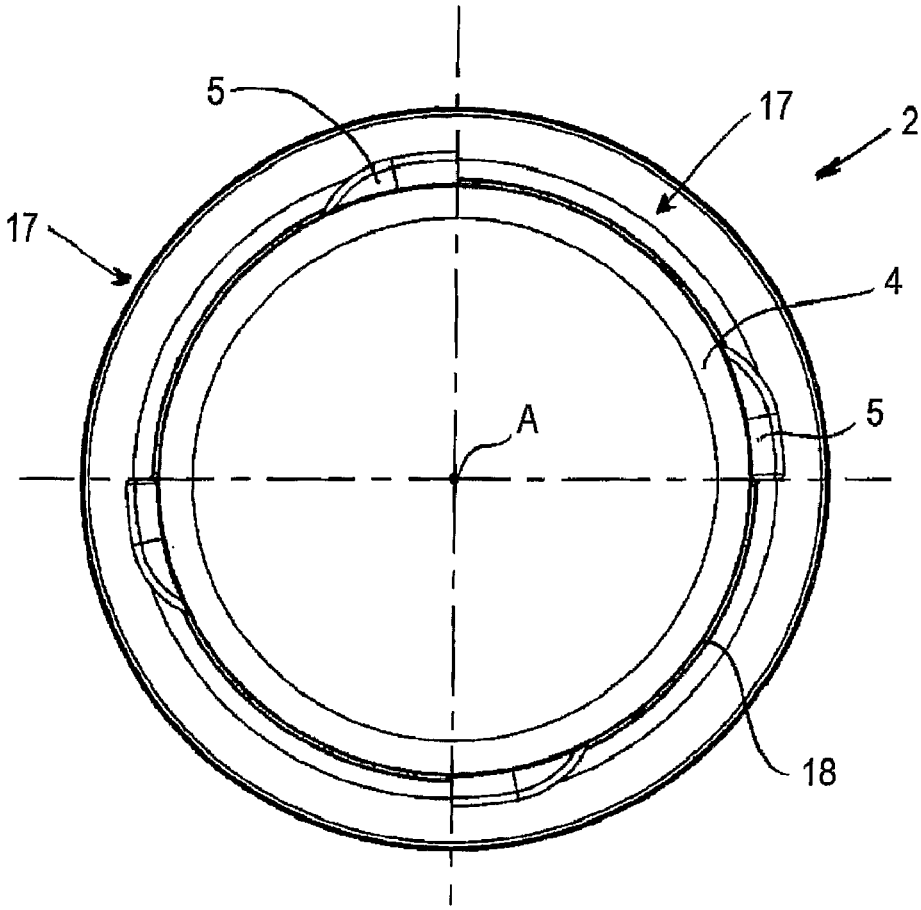
FIG. 7 is a top view of a container neck.
Figure 8:
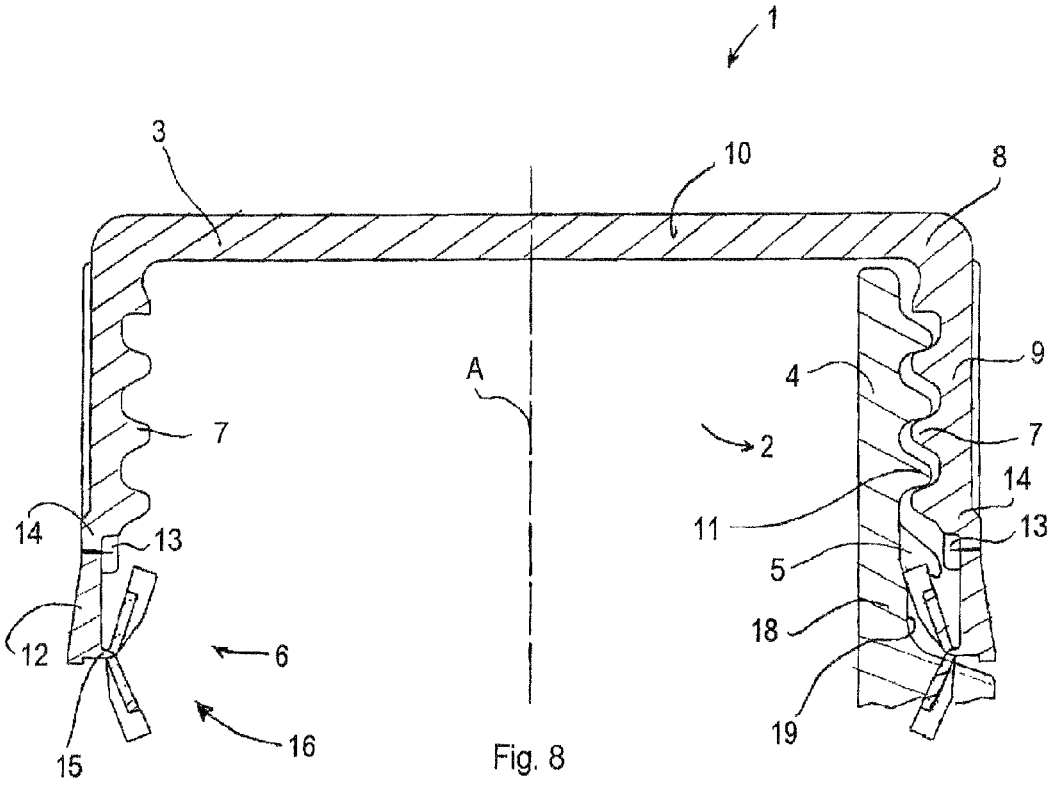
FIG. 8 is an interrupted axial section showing a cap associated with a container neck.

The cap 3 illustrated in FIGS. 17 to 20 may also be applied to a neck such as that illustrated in FIG. 7, that is to say, to a neck in which there is no ring-shaped projection 51 and the abutting elements 5 extend directly from the mouth 4.

A cap 3 different to that described with reference to FIGS. 17 to 20 may be associated with the neck 2 illustrated in FIG. 14.

Figure 22:
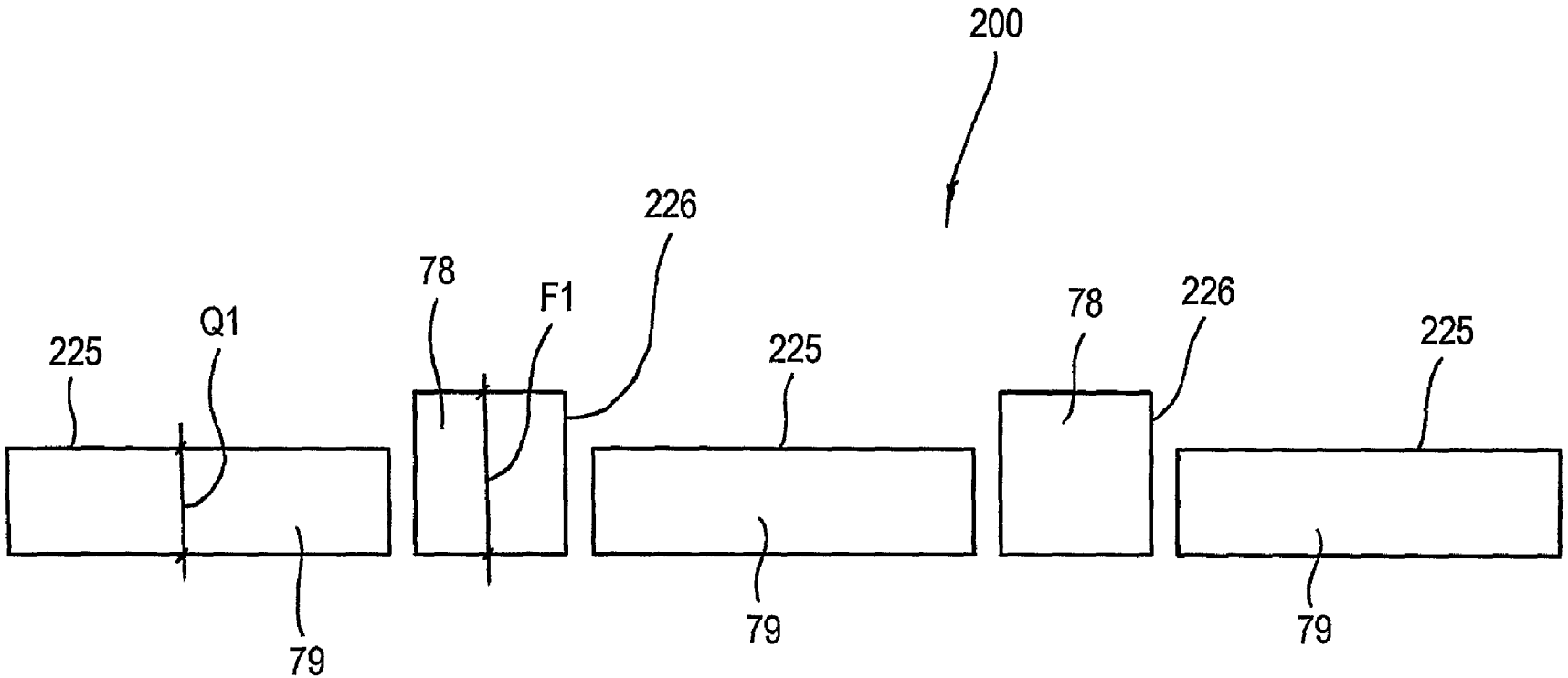
FIG. 22 is a view like that of FIG. 19 showing a flap arrangement according to a still further version.

For example, as shown in FIG. 22, a cap 3 with a plurality of flaps 200, comprising first flaps 78 and second flaps 79 positioned along the perimeter of the cap 3, may be associated with the neck 2.

The first flaps 78 may alternate with the second flaps 79 along the lower edge zone 15, so that between two consecutive first flaps 78 there is inserted a second flap 79 and, similarly, between two consecutive second flaps 79 it is inserted a first flap 78.

Each first flap 78 has a substantially constant transversal dimension F1.

Each second flap 79 has a substantially constant further transversal dimension Q1.

The transversal dimension F1 is greater than the further transversal dimension Q1.

Each first flap 78 has a first active surface 226 so arranged to interact with the second face 60 of an abutting element 5, according to manners similar to those described with reference to FIG. 17.

Each second flap 79 comprises a second active surface 225 arranged to interact with the first face 54 of the ring-shaped projection 51, and/or with the further first face 59 of the abutting element 5, according to manners similar to those described with reference to FIG. 17.

Also between the first one first flap 79 and one second flap 79 adjacent to it, may be interposed a joining element 71 of the type described with reference to FIG. 20.

The cap 3 illustrated in FIG. 22 may also be applied to a neck such as that illustrated in FIG. 7, that is to say, to a neck in which there is no ring-shaped projection 51 and the abutting elements 5 extend directly from the mouth 4. Alternatively, a cap 3 comprising a flap arrangement 16 as described with reference to FIGS. 2 to 6 and 8 to 13 may be provided.

In an alternative version, in place of the plurality of separate flaps, there may be a continuous flap, provided with variable-height flap portions. For example, with reference to FIG. 21, the opening indicating device 6 comprises a security ring 12 provided with a continuous flap 74 that is ring-shaped and comprising first portions 75 with a predetermined circumferential extension L1 and a predetermined height H1, and second portions 76 having a further predetermined circumferential extension L2 and a further predetermined height H2, greater than the predetermined height H1. Each first portion 75 is interposed between two second portions 76 in such a way that the first portions 75 and the second portions 76 alternate with one another.

Moreover, when the cap is associated with the neck 2, the second portions 76 are received in the spaces 17.

The first portion 75 comprises a first active surface 126 arranged to interact with the second face 60 of the abutting elements 5, according to methods similar to those described with reference to FIG. 17.

The second portion 76 comprises a second active surface 125 arranged to interact with the first face 54 of the ring-shaped projection 51 and/or with the further first face 59 of the abutting elements 5, according to methods similar to those described with reference to FIG. 17.

The invention claimed is:

1. Container comprising a neck and a cap associatable with said neck;

said cap comprising a base body, an opening indicating device and a breakable bridge-like arrangement arranged between said opening indicating device and said base body;

said neck comprising a wall defining an opening;

said neck having an abutting arrangement arranged to interact with said opening indicating device;

said abutting arrangement comprising a ring-shaped projection and an abutting element arrangement;

said ring-shaped projection extending circumferentially from said wall, a first face delimiting at the lower part said ring-shaped projection;

said abutting element arrangement comprising four distinct abutting elements extending radially from said ring-shaped projection;

each of said abutting elements comprising a further first face and a second face, said further first face delimiting at the lower part the respective abutting element, said second face extending transversally to said first face;

said opening indicating device comprising a flap arrangement having first flaps and second flaps arranged along an outer edge of said cap, said first flaps alternating with said second flaps so that a second flap is interposed between two consecutive first flaps and a first flap is interposed between two consecutive second flaps, each of said first flaps being positioned in a space between a pair of adjacent abutting elements, each of said second flaps being below said ring-shaped projection;

each of said first flaps comprising a first flap portion and a second flap portion, said first flap portion having a first circumferential extension and a first transversal dimension measured transversally to said outer edge, said second flap portion having a second circumferential extension and a second transversal dimension measured transversally to said outer edge, said first transversal dimension being greater than said second transversal dimension;

said first flap portion having a first active surface arranged to interact with said second face;

said second flap portion having a second active surface positioned transversally relative to said first active surface to interact with said further first face; each of said second flaps being provided with a third active surface substantially parallel to said second active surface, said third active surface being arranged to interact with said first face;

said first active surfaces cooperating with said second faces to prevent rotation of said opening indicating device when said cap is rotated to open said opening, whereby said opening indicating device is blocked whilst said base body continues to rotate, generating a shearing stress acting on said bridge-like arrangement, and said second active surfaces and said third active surfaces make contact respectively with said further first face and with said first face so as to axially block said opening indicating device relative to said base body generating a tensile stress acting on said bridge-like arrangement.

2. Container according to claim 1, wherein said four abutting elements are positioned at a constant angular pitch.

3. Container according to claim 1, wherein said abutting elements do not project axially from said ring-shaped projection.

4. Container according to claim 1, wherein said first face has the shape of a circular ring.

5. Container according to claim 1, wherein said first face is arranged substantially parallel to a plane defined by said opening.

6. Container according to claim 1, wherein said second face is tilted to a plane defined by said opening.

7. Container according to claim 1, wherein said second face is perpendicular to a plane defined by said opening.

8. Container according to claim 1, wherein said further first face is arranged substantially parallel to a plane defined by said opening.

9. Container according to claim 1, wherein said first face and said further first faces are substantially coplanar.

10. Container according to claim 1, wherein said abutting elements have a maximum thickness, measured parallel to a longitudinal axis of said neck, substantially equal to a further maximum thickness of said ring-shaped projection, measured parallel to said longitudinal axis.

11. Container according to claim 1, wherein each of said second flaps has a third transversal dimension, measured transversally to said outer edge, which is substantially constant.

12. Container according to claim 11, wherein said third transversal dimension is less than said first transversal dimension.

13. Container according to claim 11, wherein said third transversal dimension is substantially equal to said second transversal dimension.

14. Container according to claim 1, wherein between at least one of said first flaps and said at least one of said second flaps a joining element is provided, arranged to prevent said flap arrangement from tipping over.

15. Container according to claim 14, wherein said joining element comprises a flexible element.

16. Container according to claim 1, wherein said flap arrangement comprises a continuous flap.

* * * * *